US006079502A

United States Patent [19]

Davis et al.

[11] Patent Number: 6,079,502

[45] Date of Patent: Jun. 27, 2000

[54] PROCESS STATION FIRE SUPPRESSION SYSTEM

[75] Inventors: Timothy D. Davis, Muhlenberg Township, Berks County; Paul A. Grenewald, Upper Pottsgrove; Terry L. Schock, Colebrookedale, all of Pa.

[73] Assignee: Lucent Technologies Inc., Murray Hill, N.J.

[21] Appl. No.: 09/187,240

[22] Filed: Nov. 6, 1998

[51] Int. Cl.[7] ..... A62C 37/10

[52] U.S. Cl. ..... 169/61; 169/54

[58] Field of Search ..... 239/61, 60, 56, 239/54

[56] References Cited

U.S. PATENT DOCUMENTS

| | | | |
|---|---|---|---|
| 4,882,573 | 11/1989 | Leonard et al. | 340/578 |
| 4,984,637 | 1/1991 | Finnigan | 169/61 |
| 5,311,167 | 5/1994 | Plimpton et al. | 340/578 |
| 5,339,070 | 8/1994 | Yalowitz et al. | 340/578 |
| 5,651,379 | 7/1997 | Mohindra et al. | 134/95.2 |
| 5,773,826 | 9/1998 | Castleman et al. | 250/339.15 |
| 5,808,541 | 9/1998 | Golden | 169/61 X |

*Primary Examiner*—Lesley D. Morris
*Attorney, Agent, or Firm*—Ian M. Hughes; Steve Mendelsohn

[57] ABSTRACT

A fire suppression system for a process station, or chemical wet bench, employs an electro-optical fire detector and system controller to detect a fire in the process station. The system controller is coupled to a solenoid valve that is opened when a fire is detected by the fire detector, causing the fire suppressant to be delivered to a nozzle positioned in the process station. The nozzle atomizes the fire suppressant flowing through the nozzle so as to substantially cover the interior space of the process station with fire suppressant. The fire suppressant may be water provided by a local sprinkler system, and the nozzle is configured to atomize the fire suppressant when the fire suppressant is delivered to the nozzle under relatively low pressure.

12 Claims, 3 Drawing Sheets

PROCESS STATION FIRE SUPPRESSION SYSTEM

BACKGROUND OF THE INVENTION

1. Field of the Invention

The present invention relates to fire suppression systems, and, more particularly, to a fire suppression system for chemical process stations.

2. Description of the Related Art

Many applications require fabrication of devices in controlled environments that provide little or no contamination, and these controlled environments are commonly referred to as "clean rooms". Fabrication of semiconductor devices, for example, as highly integrated circuits, is typically a multi-step, chemical process performed in process stations of a clean room. Process stations, also known as, for example, wet benches, chemical wet stations, and chemical process stations, are typically constructed of materials such as polypropylene, fire-retardant polypropylene, poly-vinyl chloride (PVC) or stainless steel. Further, the process stations usually contain volatile chemicals and gases, or heated baths of corrosive chemicals, which may easily ignite, causing a fire hazard. Since many process stations may be constructed of materials that may burn, such as polypropylene or PVC, the fire hazard extends to combustion of the process station itself.

Consequently, process stations typically include a fire detection and suppression system that is coupled to plant facilities. Some process stations simply employ a sprinkler head similar to those commonly used in the sprinkler system of the plant. Some systems include more advanced fire suppression techniques. Process stations may include a fire detector that may be a heat sensor or an infrared (IR) or ultra-violet (UV) based electro-optical fire detector. These fire detectors may have an ability to detect, for example, a heat-release rate of 13-kilowatts (kW) corresponding to an 8-inch diameter polypropylene pool fire. The fire detector signals an electrically operated valve, such as a solenoid valve, to provide a fire suppressant through a nozzle to the interior of the process station to extinguish the fire.

The fire suppressant, which may be a gas or liquid, is usually distributed to the process station by a dedicated system for that station, or distributed through the plant to all process stations through a dedicated distribution (piping) system. Some spray systems employ high-pressure foam added to the liquid for added performance. Such fire suppressants and related distribution systems are costly both to install and maintain. These systems, and existing sprinkler-based systems installed in process stations, tend to provide a high volumetric flow rate of the fire suppressant, causing widespread contamination of the clean room. Alternatively, to reduce contamination, some fine-spray systems employ a gas, such as air, nitrogen or carbon dioxide, injected into the nozzle with the liquid to provide accelerated delivery and atomizing of the liquid.

SUMMARY OF THE INVENTION

The present invention relates to a fire suppression system for process stations. In accordance with the present invention, a system controller of the fire suppression system utilizes at least one fire detector to monitor for a fire in an interior space of the process station. When a fire is detected, the system controller causes a valve to open, allowing a fire suppressant to flow through at least one nozzle positioned within the interior space of the process station. The nozzle provides for atomizing of the fire suppressant passing through the nozzle and into the process station. The fire suppression system may utilize a fire suppressant from a fire suppressant supply, such as water commonly supplied from a facility sprinkler system.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Figure 1:
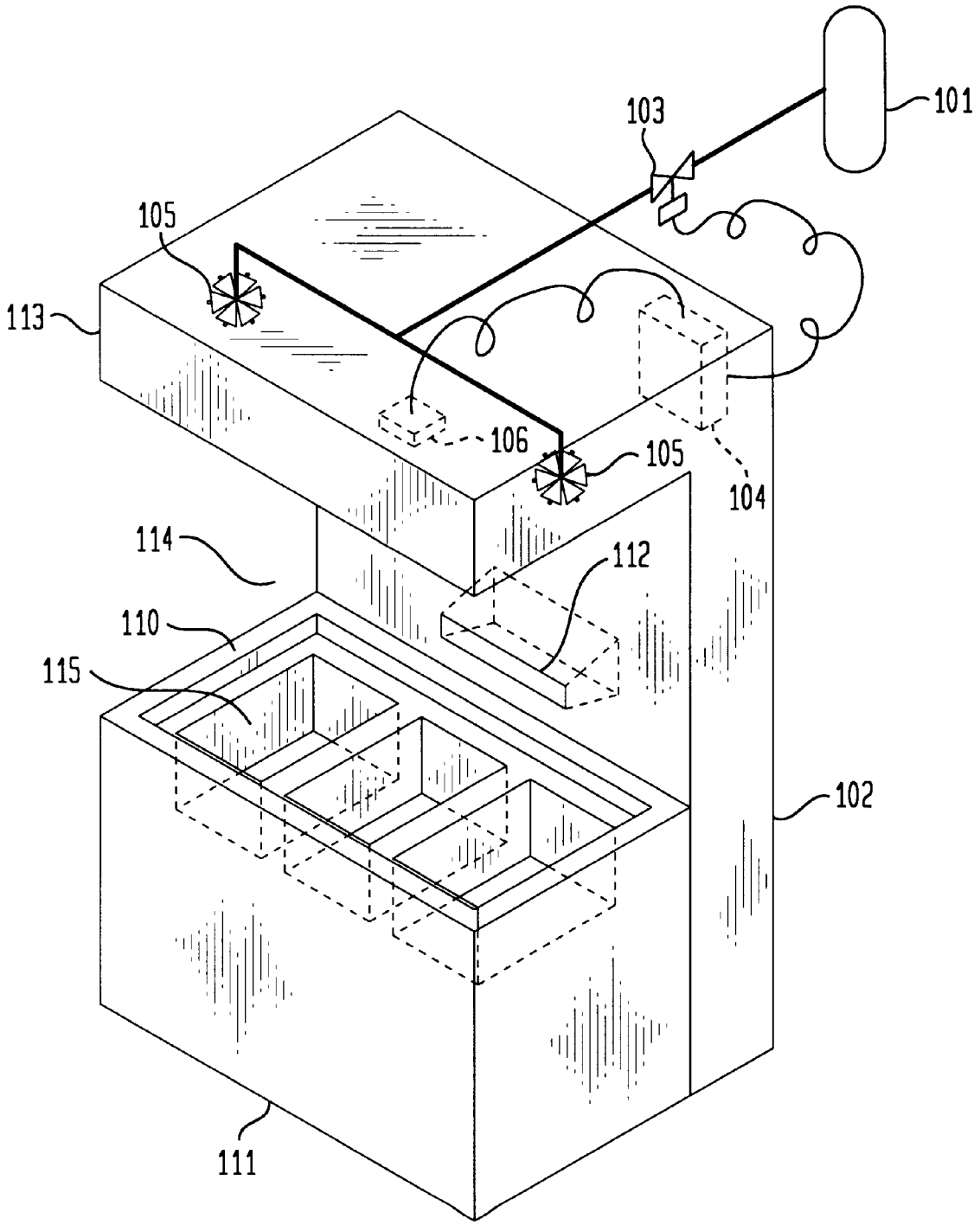
FIG. 1 shows a process station including a fire suppression system in accordance with an embodiment of the present invention.

FIG. 1 shows a process station 102 including a fire suppression system in accordance with an embodiment of the present invention. As shown in FIG. 1, the fire suppression system includes fire detector 106, nozzles 105, system controller 104, and valve 103. Process station 102 is normally constructed having a base 111 with hood 113 and working surface 110, which may possibly contain several compartments 115. The working surface 110 and hood 113 form interior space 114 that may be enclosed by a cover or door (not shown). Process station 102 may also include a vent 112 with an exhaust fan for venting fumes or other gases from the interior space 114.

The fire detector 106 of the fire suppression system is desirably positioned within the interior space 114 such that the sensing fields of the detector cover a relatively large area of the interior space 114. A single fire detector 106 as shown may be centrally positioned on the underside of the hood 113 facing the working surface 110. However, the current invention is not so limited, and several fire detectors 106 may be positioned within the interior space 114. Fire detector 106 may desirably be an electro-optical detector for increased sensitivity to products of combustion (e.g., flame, heat, smoke or particulates) since the vent 112 of the process station 102 may remove substantial amounts of smoke and particles during the initial stages of a fire. When smoke or a flame occurs, the fire detector provides a signal to the system controller 104 indicating the presence of the fire.

System controller 104 may either be positioned in the process station 102, or may be a remote system controller monitoring fire detectors of several process stations. System controller 104 receives signals from fire detector 106 indicating the presence of a fire within interior space 114. System controller 104 is also electrically coupled to valve 103, which may be a solenoid valve, and the position of the valve is determined by the signal provided to valve 103 by the system controller 104.

Nozzles 105 are positioned in the interior space 114, and valve 103 couples each nozzle 105 to a fire suppressant supply 101 through tubing (e.g., pipe, tube, conduit, or hose). The valve 103 is normally in the closed position. The fire suppressant of the fire suppressant supply 101 is desirably a liquid such as water provided from the sprinkler system of the plant. Consequently, fluid pressure of the fire suppressant may be on the order of 100 to 180 pounds per square inch (psi). When the system controller 104 receives a signal from fire detector 106 indicating the presence of a fire, the system controller 104 provides a signal causing the valve 103 to move to the open position. When valve 103 moves to the open position, fire suppressant flows through the tubing to nozzles 105.

Figure 2:
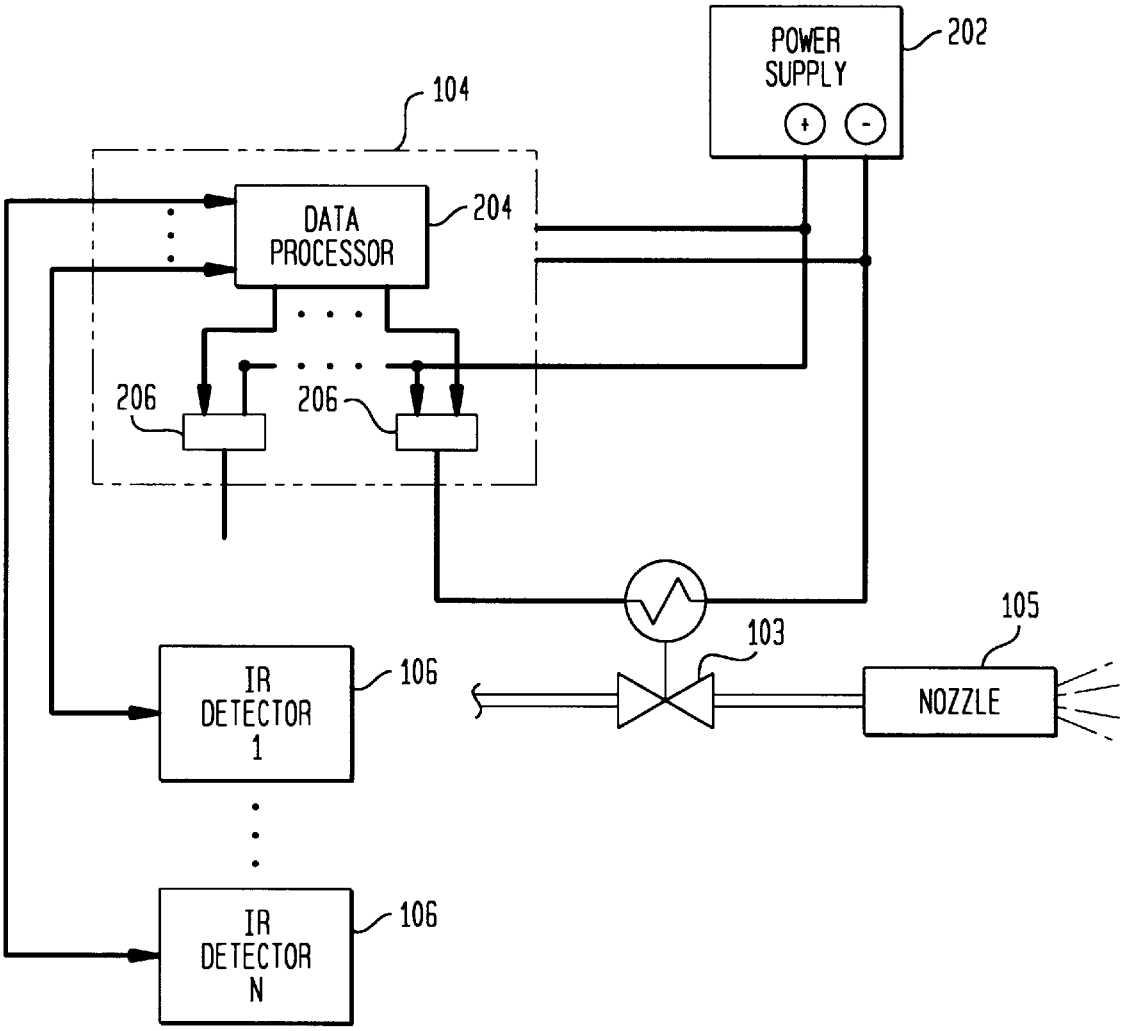
FIG. 2 shows a block diagram of an implementation of the fire suppression system in accordance with the present invention.

FIG. 2 shows an implementation of the fire suppression system in accordance with the present invention. System controller 104 includes a data processor 204 and relays 206. System controller 104 is coupled to N fire detectors, N an integer greater than 0, which are shown in FIG. 2 as IR (electro-optic) detectors. System controller 104 is also coupled to first and second terminals of a power supply 202, the relays 206 each coupled to the first terminal of the power supply. The valve 103 may be a solenoid valve having one solenoid terminal coupled to a second voltage terminal of a power supply, and the other solenoid terminal coupled to a corresponding one of the relays 206.

Data processor 204 monitors output signals of each of the N fire detectors 106. When the output signal of a fire detector 106 indicates the presence of a fire, the data processor 204 causes the corresponding relay 206 to close. Closure of the corresponding relay 206 electrically couples the corresponding solenoid terminal to the first terminal of the power supply, energizing the solenoid of, and therefore opening, the valve 103. Further, once the fire is extinguished, the fire detector may provide a signal indicating an absence of the fire. The data processor 204 then opens relay 206, which de-energizes the solenoid of, and so closes, the valve 103. Consequently, the fire detector 106 and the system controller 104 may also be employed to stop the flow of fire suppressant liquid to nozzles 105 when the fire is extinguished. Terminating the flow of fire suppressant after the fire is extinguished may minimize contamination of, for example, other process stations in the clean room.

Such system controller and fire detectors are commercially available and may be, for example, an FS System 4 channel controller model 050-5006 and FS7-2173 dual frequency electro-optical fire detectors, respectively, available from Fire Sentry of Cleveland, Ohio. Electrically controlled valve 103 may be, for example, a solenoid valve model 8210G4 available from Asco of Florhan Park, N.J.

While the fire suppression system is described herein having a fire detector, system controller, and valve, the present invention is not so limited. For example, the signal of the fire detector indicating a presence or an absence of a fire may be directly employed to energize a solenoid valve, causing the fire suppressant to flow through the nozzle. In the alternative, the fire detector may be a mechanical device incorporating a valve, the mechanical device having a characteristic changing with temperature so as to open the valve in the presence of a fire. Consequently, the terms "fire detector" and "system controller" as employed herein describe the operation of one or more devices, alone or in combination, detecting a fire and causing a fire suppressant to flow to a nozzle.

Returning to FIG. 1, nozzles 105 are positioned inside the interior space 114, and may desirably be mounted to and under the hood 113 so as to face the working surface 110 and so as to direct the spray pattern of the nozzle into the interior space 114. Although FIG. 1 shows two nozzles, one nozzle or three or more nozzles may be employed. Each nozzle 105 includes one or more orifices, also known as spray caps, through which the fire suppressant flows. Each orifice is configured so as to atomize the fire suppressant passing through the orifice. As described herein, "atomize" refers to providing the liquid as a fine spray in contrast to a liquid stream.

Nozzles 105 are desirably selected so as to atomize the fire suppressant, such as water, into a cone-shaped spray pattern of relatively small fluid droplets, even for a fire suppressant supply 101 having a relatively low pressure, (i.e., between 100 and 180 psi). Atomizing of the fire suppressant allows for a relatively low volumetric flow rate of the fire suppressant, such as between 2 to 4 gallons per minute, reducing the possibility of contamination from spillage or overflow. For some applications, the low volumetric flow rate of the fire suppressant to the interior space 114 may allow for draining of the liquid from the process station directly. Therefore, water damage to the clean room may be minimized since the fire suppression operation is contained within the process station. Such volumetric flow rates and spray pattern coverage may be determined from standards in the art. Such standards may include a time to extinguish a process station fire of certain energy and may be specified by, for example, Factory Mutual.

Figure 3A:
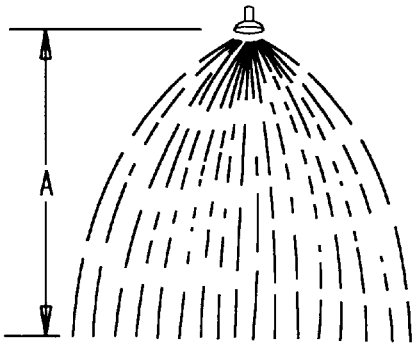
FIG. 3A shows a side view of a spray pattern of a nozzle employed by the fire suppression system in accordance with an embodiment of the present invention.
Figure 3B:
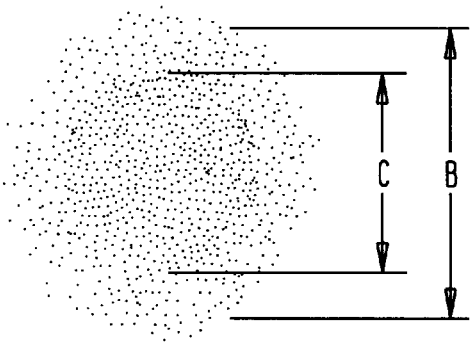
FIG. 3B shows a bottom view of a spray pattern of a nozzle employed by the fire suppression system in accordance with an embodiment of the present invention.

FIG. 3A shows a side view, and FIG. 3B shows a bottom view, of a spray pattern of a nozzle employed by the fire suppression system in accordance with an embodiment of the present invention. Such a spray nozzle may be, for example, a FogJet spray nozzle model 7N available from Spraying Systems Co. of Wheaton, Ill. FIG. 3A illustrates the cone pattern paths of the fine spray droplets, and FIG. 3B shows the relative density of droplets of the cone pattern. As shown in FIGS. 3A and 3B, an atomizing nozzle allows for wide area coverage of fire suppressant, with dimension "A" of FIG. 3A being 3–7 feet and dimensions "B" and "C" being between 10–12 ft and 6–8 ft, respectively. Such a nozzle may provide, for example, up to 4.8 gallons of water per minute with water supplied at 100 psi, and up to 5.9 gallons per minute with water supplied at 150 psi.

In accordance with the present invention, the fire suppression system for a process station allows for the following advantages. First, atomizing the fire suppressant reduces the flow rate to minimize contamination of the clean room. The fire suppression system requires relatively little modification to a process station, allowing for 1) retrofitting existing process stations easily and 2) continued use of, for example, PVC process stations that may normally be retired due to the combustion characteristics of PVC. Further, the fire suppression system of the present invention may employ water supplied from an existing fire sprinkler system, reducing the cost of installation and removing the need for a separate compressed gas to atomize the fire suppressant. An implementation of the fire suppression system has relatively low cost, since many of the components are inexpensive and commercially available.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A fire suppression system for a process station, the fire suppression system comprising:

an atomizing nozzle adapted to be coupled to a fire suppressant supply through tubing, the tubing having a valve between the nozzle and the fire suppressant supply;

a fire detector adapted to generate a signal indicating a presence of a fire in the process station; and a system controller adapted to control the valve based on the signal from the fire detector, wherein, when the valve is opened, the atomizing nozzle atomizes the fire suppressant having a relatively low pressure of about 100–180 psi or less flowing into the process station through the atomizing nozzle and from the fire suppressant supply.

2. The invention as recited in claim 1, wherein the process station is a chemical wet bench employed in semiconductor manufacturing.

3. The invention as recited in claim 2, wherein the process station is a chemical wet bench constructed of either PVC or polypropylene.

4. The invention as recited in claim 1, wherein the nozzle is positioned within an interior space of the process station and the fire suppression supply is a sprinkler system, the nozzle atomizing the fire suppressant flowing from the sprinkler system to substantially cover a volume of the interior space.

5. The invention as recited in claim 4, wherein the fire suppressant is water having a pressure of less than about 200 psi as the water flows from the sprinkler system to the nozzle.

6. The invention as recited in claim 1, wherein the fire detector is an electro-optical detector positioned within an interior space of the process station.

7. The invention as recited in claim 1, wherein the system controller closes the valve based on a change in state of the signal generated by the fire detector, the change in state indicating an extinguished fire.

8. A fire suppression system for a semiconductor process station of a clean room, the fire suppression system comprising:

an atomizing nozzle adapted to be coupled to a fire suppressant supply through tubing, the tubing having a solenoid valve between the nozzle and the fire suppressant supply;

an electro-optical fire detector adapted to generate a signal indicating a presence of a fire in the semiconductor process station; and a system controller electrically coupled to the solenoid valve and adapted to open the solenoid valve based on the signal from the fire detector, wherein, when the valve is opened, the atomizing nozzle atomizes the fire suppressant having a relatively low pressure of about 100–180 psi or less flowing into the semiconductor process station through the atomizing nozzle and from the fire suppressant supply.

9. The invention as recited in claim 8, wherein the nozzle is positioned within an interior space of the process station and the fire suppressant is water from a sprinkler system having a pressure of less than about 200 psi, the nozzle atomizing the water flowing from the sprinkler system.

10. The invention as recited in claim 8, wherein the system controller closes the valve based on a change in state of the signal generated by the electro-optical fire detector.

11. The invention as recited in claim 1, wherein the fire suppressant flows through the atomizing nozzle with a relatively low volumetric flow rate of about 2 to 4 gallons per minute.

12. The invention as recited in claim 8, wherein the fire suppressant flows through the atomizing nozzle with a relatively low volumetric flow rate of about 2 to 4 gallons per minute.

* * * * *